United States Patent [19]

Ebert

[11] Patent Number: 4,770,108

[45] Date of Patent: Sep. 13, 1988

[54] TWO-WAY VENT CAP FOR CONTROLLED ATMOSPHERE FURNACE

[75] Inventor: Michael J. Ebert, Loves Park, Ill.

[73] Assignee: Abar Ipsen Industries, Inc., Feasterville, Pa.

[21] Appl. No.: 78,556

[22] Filed: Jul. 28, 1987

[51] Int. Cl.[4] ..... F23N 5/24

[52] U.S. Cl. ..... 110/193; 110/163; 110/173 B; 126/293

[58] Field of Search ..... 110/193, 163, 173 B; 126/292, 293; 98/59

[56] References Cited

U.S. PATENT DOCUMENTS

| | | | |
|---|---|---|---|
| 3,123,028 | 3/1964 | Bodeker | 110/163 |
| 3,957,001 | 5/1976 | Round | 110/173 B |
| 4,329,967 | 5/1982 | Levenberg | 126/293 |
| 4,497,310 | 2/1985 | Funke | 126/292 |

*Primary Examiner*—Edward G. Favors

*Attorney, Agent, or Firm*—Dann, Dorfman, Herrell and Skillman

[57] ABSTRACT

A vent cap for a heat treating furnace provides bidirectional pressure relief. The cap is weighted and balanced over the furnace vent such that the vent is closed as long as the furnace has a slightly positive internal pressure. If the internal pressure exceeds a preselected upper limit the cap opens the vent to relieve the overpressure. The vent cap has a controlled inlet which opens to equalize the pressure differential if the internal pressure falls below a preselected lower limit below the ambient pressure outside the furnace. Such controlled equalization prevents the formation of undesirable combustible mixtures of air and treating gas in the furnace.

14 Claims, 2 Drawing Sheets

FIG. 3
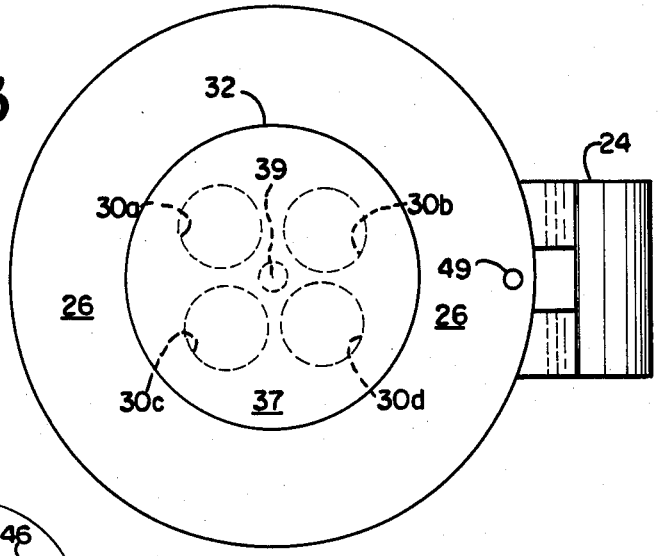
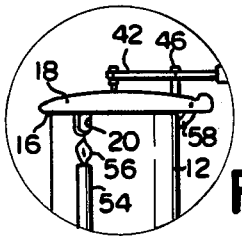
FIG.1A
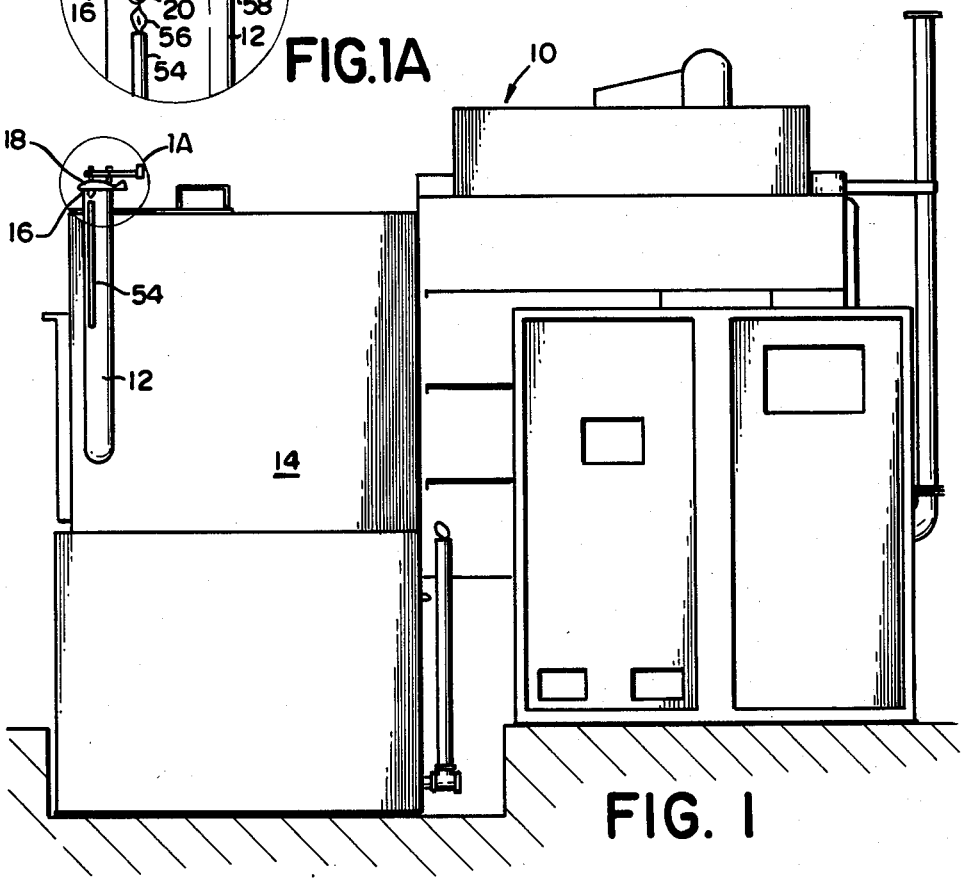
FIG. 1

TWO-WAY VENT CAP FOR CONTROLLED ATMOSPHERE FURNACE

FIELD OF THE INVENTION

This invention relates generally to vents for controlled atmosphere furnaces, and in particular, to a vent cap which provides not only relief of positive overpressure, but also a controlled inlet to stabilize the furnace against negative pressure transients.

BACKGROUND OF THE INVENTION

Controlled atmosphere furnaces of the type used for heat treating materials need to be protected against internal overpressurization. One means for preventing such overpressurization is a large vent hole or pipe for venting the interior of the furnace. The hole or pipe often communicates with the quench vestible of the furnace. A small pilot flame is maintained near the vent hole or near the open end of the vent pipe to burn the combustible gases vented from the interior of the furnace.

A drawback of such an arrangment is that a relatively large flow of protective atmosphere gas is needed to keep the interior of the furnace at a slightly positive pressure. Without a positive pressure, it becomes difficult to control the atmosphere inside the furnace. When high gas flow rates are utilized in order to maintain a positive pressure inside the furnace, a significant amount of gas is wasted.

A known solution to the problem of maintaining positive pressure inside the furnace without high gas flow rates is the use of a vent cap over the vent hole or pipe. By restricting the size of the vent opening, the vent cap maintains a slightly positive pressure inside the furnace while still permitting the atmosphere gas to vent and be burned off by the pilot flame. During negative pressure transients inside the furnace, however, the vent cap seals off the vent opening and inhibits stabilization of the negative pressure condition. Accordingly, the furnace is equipped with a small pilot hole in the vent pipe adjacent the cap to prevent the furnace from being sealed off during such negative pressure transients. Under normal operating conditions, however, the small hole acts as a vent for controlled burning of the combustible gases by the pilot flame.

Large negative pressure transients can cause air to be drawn into the furnace and form undesirable combustible mixtures with the treating gas inside the furnace. There are two possible sources for this air leakage. First, in well sealed furnaces, the air inflow through the pilot hole must be great in order to balance the pressure differential between the interior of the furnace and the exterior. This means that the velocity of the air passing through the pilot hole is very high and often the pilot flame cannot be sustained in such high velocity air. Consequently, the air passing through the hole is not burned. Secondly, many furnaces are equipped with seals which are designed for the slightly positive pressures of normal operation. However, should the furnace internal pressure go too far negative, air can leak into the furnace through these seals.

SUMMARY OF THE INVENTION

Accordingly, it is a principal object of this invention to provide relief of both over pressurization and negative pressure transients in a controlled atmosphere furnace.

It is a further object of this invention to quickly balance pressure differentials between the interior of a controlled atmosphere furnace and the exterior thereof.

Another object of this invention is to provide a vent cap for a controlled atmosphere furnace which maintains a slightly positive pressure inside the furnace.

A still further object of this invention is to provide such a vent cap which will permit the internal furnace pressure to stabilize when it goes negative.

Another object of this invention is to prevent the formation of explosive mixtures of combustible gas and air inside a controlled atmosphere furnace during negative pressure transients in the furnace.

The above and other objects are embodied in a cap which is formed to cover the opening of a vent on controlled atmosphere furnace. The cap is mounted over the vent opening and is balanced to maintain the pressure inside the furnace below a preselected pressure limit. An aperture is formed in the cap to provide a passageway through the cap body. The vent cap also includes means for selectively opening and closing the aperture in response to pressure conditions inside the furnace. Under normal operating conditions, the aperture is closed to provide a slight positive pressure inside the furnace. Under negative pressure transients, the aperture is opened quickly in order to balance the pressure differential without the formation of a combustible mixture inside the furnace.

BRIEF DESCRIPTION OF THE DRAWINGS

The foregoing summary, as well as the following detailed description of a preferred embodiment of the present invention, will be better understood when read in conjunction with the appended drawings in which:

FIG. 1 shows a general elevation view of a controlled atmosphere furnace employing a vent cap according to the present invention;

FIG. 1A is an enlarged view of the vent cap encircled at 1A shown in FIG. 1;

FIG. 3 shows the vent cap of FIG. 2 as viewed along the line 3—3.

DESCRIPTION OF THE PREFERRED EMBODIMENT

Figure 2:
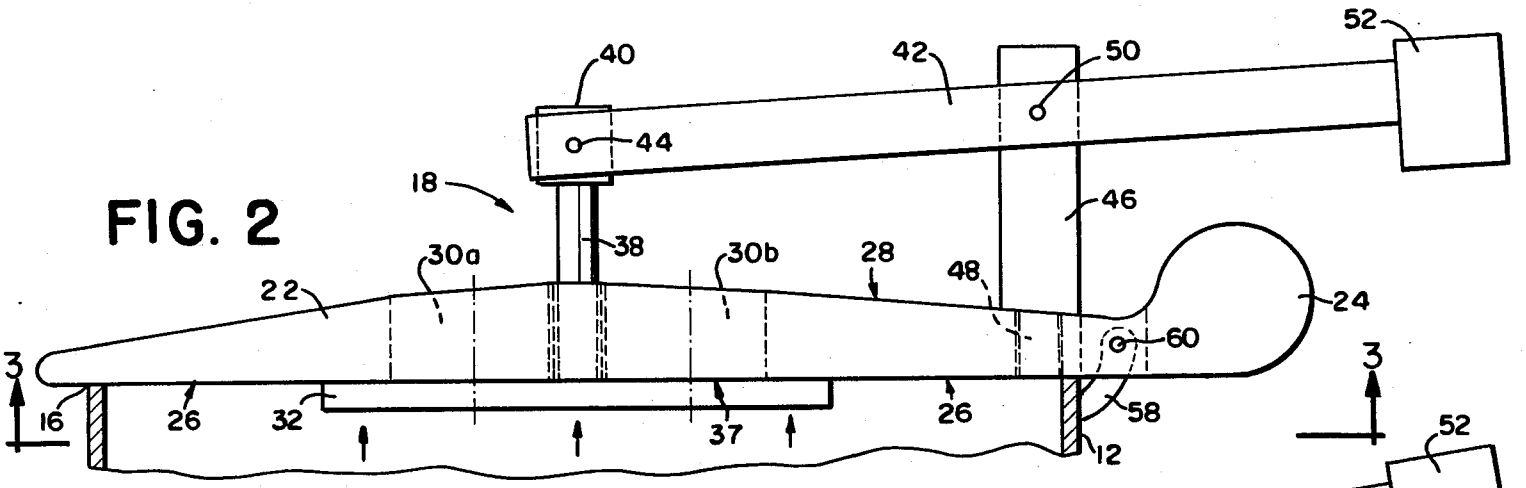
FIG. 2 shows an elevational view of a vent cap embodying the present invention in the normal or closed condition.

Referring now to the drawings wherein like reference numerals indicate identical or corresponding parts among the several views and in particular to FIG. 1, there is shown generally a controlled atmosphere, heat treating furnace 10. A vent pipe 12 extends from a quenching chamber 14 in furnace 10. The vent pipe 12 communicates with the interior of the quenching chamber 14 in order to vent the atmosphere gas from the furnace 10. The vented gas exits through the exhaust end 16 of vent pipe 12.

As shown more clearly in FIG. 1A, a vent cap 18 is mounted over the exhaust end 16 of vent pipe 12. A pilot hole 20 is provided in the exhaust end 16 to permit continuous venting, as will be described more fully herein below. The vent cap 18 is shown in greater detail in FIGS. 2 and 3.

Referring now to FIGS. 2 and 3 the vent cap 18 has a body portion 22 and a counterbalancing tail portion 24. The vent cap 18 is connected to a pivot bracket 58 with a pivot bolt or pin 60. The body portion 22 includes a substantially planar annular surface 26 cooperating with and closing the end of vent pipe 12 and a contoured external surface 28 tapering to a rounded generally circular edge. In one embodiment of the invention, a disk 32 is positioned over an aperture defined by a plurality of inlet bores 30*a*, 30*b*, 30*c*, and 30*d* formed through the body 22, extending between surface 28 and surface 26. The disk 32 is dimensioned to substantially completely close off the bores 30*a*, 30*b*, 30*c*, and 30*d*. To this end, the surface 37 of disk 32 is juxtaposed with the annular surface 26.

Figure 4:
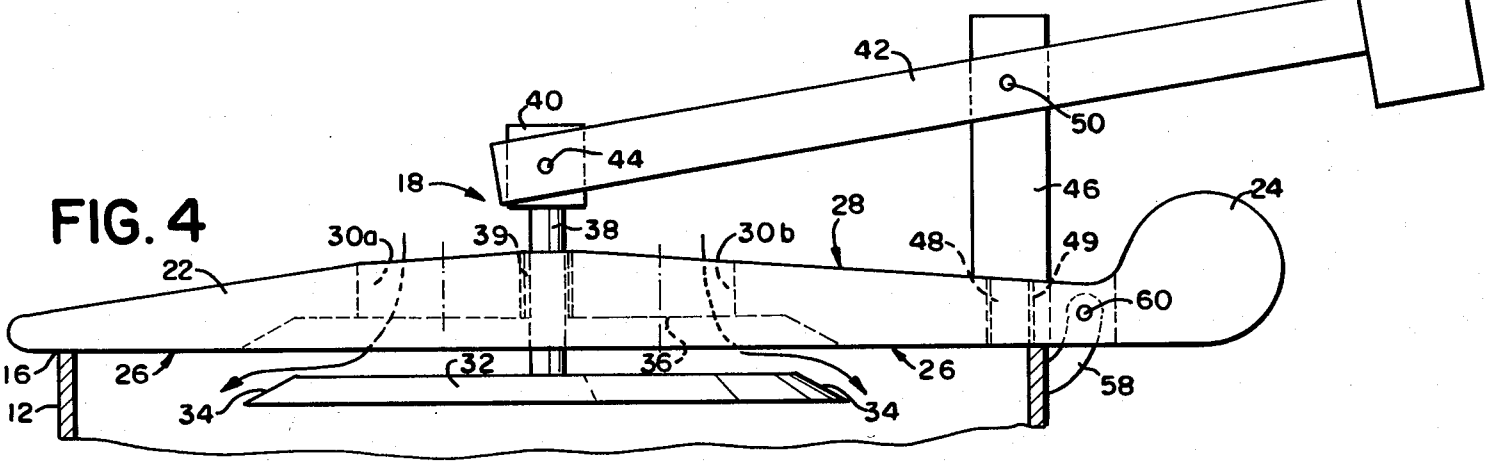
FIG. 4 shows an elevational view of another vent cap embodying the present invention in the open condition.

In another embodiment of the invention, as shown in FIG. 4, the disk 32 has a tapered edge 34 and is seated in a recess 36 in the body portion 22. The bores 30*a*, 30*b*, 30*c* and 30*d* terminate in the recess. When the disk 32 is fully seated in the recess, it substantially completely closes off the bores 30*a*, 30*b*, 30*c* and 30*d*.

The disk 32 is maintained against surface 26 by a counterbalance mechanism. The counterbalance mechanism as shown in FIG. 2 includes an extension post 38 which is connected at one end to the disk 32 through the body 22 of the vent cap 18. The extension post 38 traverses a central bore 39 in the body 22. The bore 39 is dimensioned to permit the extension post 38 to slide freely therein. The other end of the extension post 38 terminates in a connector 40. A lever 42 is connected at one end to the connector 40 by means of a pin or bolt 44 permitting relative rotation between the connected pieces. A fulcrum stem 46 is mounted on the vent cap 18 near the counterbalancing tail 24 of vent cap 18. The lever 42 is pivotally connected to the fulcrum stem 46 by means of a pivot bolt or pin 50. A counterbalancing weight 52 is attached to the other end of lever 42. The counterbalanced weight 52 is selected to just overcome the weight of the disk in order to maintain the disk 32 in the closed position as shown, which is the normal operating condition of the vent cap 18.

The operation of the vent cap 18 according to the present invention may be more clearly understood by referring to FIGS. 1, 1A, 2, and 4 in connection with the following description. The furnace 10 includes a pilot tube 54 adjacent the vent pipe 12 for conducting a pilot fuel from the fuel source (not shown) to a pilot flame 56. Under normal furnace operating pressures the vent cap 18 will be closed and thus closes off the exhaust end 16 of vent pipe 12 except for the pilot hole 20. Excess gas will normally be vented through the pilot hole 20 and burned off by the pilot flame 56. Should the furnace 10 begin to develop a positive pressure greater than a limit preset by the weight of the cap body 22, including the counterbalance mechanism, the vent cap 18 will open exhaust end 16 in order to equalize the pressure. To this end the weight of the vent cap 18 including the counterbalancing structure is designed to hold the vent closed up to the pressure limit which is desired inside the furnace 10. As vent cap 18 pivots open to relieve the excess pressure, the vented gas is burned off with the pilot flame 56.

If, on the other hand, a sudden negative pressure occurs in the furnace 10, the disk 32 will be drawn away from surface 26 on vent cap 18 thereby permitting air to flow through the aperture defined by boreholes 30*a*, 30*b*, 30*c* and 30*d* and into the vent pipe 12 in a controlled manner, as indicated by the arrows in FIG. 4. As long as a negative pressure is present inside the furnace, air will also be drawn in through the pilot hole 20. Due to the ingress of air through the vent cap aperture the velocity of the air moving inward through the pilot hole 20 is not very great and thus the pilot flame 56 will be drawn in and burn off the gas-air mixture just inside the exhaust opening 16 in vent pipe 12. The larger volume of air thus moving into the furnace in response to the negative pressure quickly stabilizes the furnace pressure. And thus, the system is rebalanced in a short time.

When the pressure balance is restored, the counterbalance mechanism automatically closes off the inlet bores 30*a*, 30*b*, 30*c*, and 30*d* by drawing the disk 32 back against surface 26.

It can be seen from the foregoing description and the accompanying drawings that the present invention provides a novel apparatus for providing two-way pressure relief in a controlled atmosphere heat treating furnace. The invention is embodied in a vent cap which is formed to close off a furnace vent and thereby maintain a slightly positive pressure inside the furnace. The vent cap operates to relieve overpressurization of the furance by uncovering the vent opening when the interior pressure exceeds a predetermined limit. A distinct advantage of the vent cap according to this invention is an inlet gate or valve in the vent cap which permits relief of negative pressure inside the furnace in a controlled manner. The inlet valve permits rapid restabilization of the furnace pressure without the formation of explosive mixtures of air and gas in the furnace and without extinguishing the pilot.

It will be recognized by those skilled in the art that changes or modifications may be made to the above-described embodiment without departing from the broad, inventive concepts of the invention. It is understood, therefore, that the invention is not limited to the particular embodiment disclosed, but is intended to cover all modifications and changes which are within the scope and spirit of the invention as defined in the appended claims.

What is claimed is:

1. Apparatus for providing bidirectional pressure relief in a controlled atmosphere furnace of the type including a gas vent, said apparatus comprising:

a vent cap formed to cover an open end of the vent, having an aperture through said vent cap, said vent cap normally closing the vent and being movably mounted relative to the vent to maintain the vent normally closed such that when pressure inside the furnace exceeds a preselected upper pressure the vent cap will open in response to pressure above that pressure and reclose after pressure drops below the pressure; and means associated with said vent cap for selectively opening and closing the aperture such that said aperture is closed when the pressure in the furnace is above a preselected pressure lower than that external to the furnace and is opened when the pressure in the furnace falls to or below the preselected lower pressure.

2. Apparatus as recited in claim 1 wherein said selective opening and closing means comprises:

a closure for the aperture on that side of the vent cap facing the vent; and counterbalancing means connected to said closure by movable means extending through the vent cap such that said aperture is closed only when the pressure in the furnace is equal to or greater than that external to the furnace.

3. Apparatus as recited in claim 2 wherein said counterbalancing means comprises:

a lever weighted at one end;

pivot means coupled to said lever; and extension means connected to said closure, movably extending through said vent cap, and pivotally connected to the other end of said lever.

4. Apparatus as recited in claim 2 wherein said closure comprises a plate dimensioned and positioned for closing the aperture.

5. Apparatus as recited in claim 4 wherein said plate has a surface juxtaposed with that side of the vent cap facing the vent.

6. Apparatus as recited in claim 4 wherein the vent cap has a recess in the side facing the vent, said recess being dimensioned to receive said plate.

7. An improved vent cap of the type used to cover a gas vent in a combustible atmosphere furnace and which is displaceable to open the gas vent for providing relief of positive pressure transients in the atmosphere furnace, wherein the improvement comprises:

said vent cap having an aperture formed therethrough; and means for selectively opening and closing the aperture such that said aperture is normally closed when the pressure in the furnace is at or below a first preselected pressure and said aperture is opened when the pressure in the furnace falls to a second preselected pressure lower than that external to the furnace.

8. Apparatus as recited in claim 7 wherein said selective opening and closing means comprises:

a planar member dimensioned and positioned for closing off the aperture; and means for counterbalancing said planar member such that the aperture is closed only when the pressure in the furnace is equal to or greater than the ambient pressure external to the furnace.

9. In a heat treating furnace of the type utilizing a positive pressure of a combustible treating gas, apparatus for controlling the gas pressure comprising:

venting means for continuously venting a portion of the combustible treating gas;

a cap formed to cover said venting means, said cap being weighted and balanced on said venting means to maintain the pressure in the furnace below a first preselected pressure, said cap having a aperture formed therethrough; and means associated with said cap for selectively opening and closing the aperture such that said aperture is closed when the pressure in the furnace is above the first preselected pressure and is opened when the pressure in the furnace falls to or below a second preselected pressure lower than that external to the furnace, whereby both positive and negative pressure transients in the furnace are controlled.

10. Apparatus as recited in claim 9 wherein said selective opening and closing means comprises:

a plate dimensioned and positioned for closing off the aperture; and means for counterbalancing said plate.

11. Apparatus as recited in claim 9 wherein the aperture comprises a plurality of boreholes.

12. Apparatus as recited in claim 10 wherein said plate is in the form of a disk.

13. Apparatus as recited in claim 12 wherein the cap has a recess formed to receive said disk.

14. Apparatus as recited in claim 12 wherein said disk has a surface juxtaposed with that side of the cap facing the venting means.

* * * * *